US006299379B1

(12) United States Patent
Lewis

(10) Patent No.: US 6,299,379 B1
(45) Date of Patent: Oct. 9, 2001

(54) REFLECTIVE TRAIL MARKERS

(75) Inventor: Roger D. Lewis, Nekoosa, WI (US)

(73) Assignee: Lewis Hunting Accessories, Mfg., Inc., Nekoosa, WI (US)

( * ) Notice: Subject to any disclaimer, the term of this patent is extended or adjusted under 35 U.S.C. 154(b) by 0 days.

(21) Appl. No.: 09/157,130

(22) Filed: Sep. 18, 1998

(51) Int. Cl.[7] ..... E01F 9/00

(52) U.S. Cl. ..... 404/9

(58) Field of Search ..... 404/9, 12, 14; 116/63 P, 209; 359/543, 544, 545; 24/711.4

(56) References Cited

U.S. PATENT DOCUMENTS 2,213,708 * 9/1940 Lange ..... 359/543
2,264,605 * 12/1941 Ackerman ..... 359/545
3,834,789 * 9/1974 Brudy ..... 404/9

OTHER PUBLICATIONS

Product literature illustrating Original Bright Eyes Highly Reflective Tacks and Bright Eyes All "Way" Shine Tacks No Date.

* cited by examiner

*Primary Examiner*—Thomas B. Will
*Assistant Examiner*—Kristine Markovich
(74) *Attorney, Agent, or Firm*—Foley & Lardner

(57) ABSTRACT

A reflective trail marker which may be used to form an outdoor trail which is highly visible at night is provided. The reflective trail marker has a generally "hour-glass" shaped marker head, having a central portion and top and bottom cap portions. The central portion has a light reflective side wall surface. The top and bottom cap portions have non-reflective surfaces, and preferably overhang the reflective side wall surface of the central portion. Reflective trail markers may be attached to horizontal support structures, for 360° reflection, to mark a trail easily visible at night when a light is shined on the trail from any angle, or may be attached to vertical support structures, for limited angle reflection, to form a secret trail. A metal pin preferably extends from the bottom cap portion to allow easy attachment and removal of the marker from a tree or other support structure. A plurality of reflective trail markers in accordance with the present invention may be included in a kit, wherein each reflective trail marker in the kit has a top cap portion colored the same color.

8 Claims, 4 Drawing Sheets

REFLECTIVE TRAIL MARKERS

FIELD OF THE INVENTION

This invention pertains generally to the field of accessories used by outdoor sportsmen, such as hunters, to find their way outdoors, and more particularly to devices and methods for marking trails and location references in outdoor areas such as a forest.

BACKGROUND OF THE INVENTION

Hunters, hikers and participants in other outdoor activities often need or would like to know where they are or where they have been in a forest or other outdoor area. A hunter, for example, would like to be able to find her way back to a choice hunting location. She may want to let another hunter who is to join her later know where she is and what path she has followed. A hunter may need to leave her prize temporarily to get help to carry the killed animal away, in which case she needs to be able to find her way back to the spot of the kill relatively quickly.

Finding one's way outdoors traditionally is accomplished with the help of distinctive landmarks, such as a particular rock, a stream, or an unusual tree. But this can be very difficult if one is not familiar with the surrounding environment, or distinctive landmarks are lacking. Outdoor location identification is particularly difficult in the night, when natural landmarks are not easily visible. Thus, hunters and outdoor sportsmen will often mark their trail as they proceed to or from a particular location. The marked trail can easily be followed to the location by the sportsmen at a later date or by others who follow.

A variety of devices and methods are known for marking trails outdoors. Typically, such methods involve placing permanent or removable marks on the ground, trees or other objects, or leaving a trail of markers on or in the ground, trees, etc. Reflective trail markers have become popular because they provide an inexpensive, easy method of marking trails and are highly visible at night when a light source is shined on them. Pieces of reflective tape, for example, are used to mark trails by placing the tape on trees or other objects, but such tapes are often not easily securely applied and removed.

One type of reflective trail marker currently on the market resembles a thumbtack having a head which is coated with a reflective coating, such as reflective paint. Such a marker can be pressed into a tree's bark easily with one hand. The ability to place a trail marker with only one hand is an important advantage, for one's hands are usually occupied with other equipment or accessories when participating in outdoor activities. A series of such markers pressed into trees forms an easily visible trail. The reflective markers are made highly visible in the dark from a distance by shining a light, e.g., from a flashlight, onto them. However, the heads of these reflective markers are flat, with a slight curvature. Thus, a light source must shine onto the head at a nearly perpendicular angle for the reflected light to be visible by a person at the source of the light. Also, such tacks can be difficult to remove from the trees or other structures in which they are placed.

Another reflective trail marker currently on the market resembles a tack having a cylindrical head, with the pin portion of the tack extending from one end of the cylinder. This type of trail marker is more easily placed in and removed from trees and other structures. A reflective coating, of tape or paint, is placed substantially entirely around the cylindrical head. Such a reflective head reflects source light directly shined onto it from any angle (360° reflection). However, for any particular angle of incident source light, the actual reflective area can be effectively very small. Therefore, the reflective marker's effective reflective distance is always relatively short. Moreover, since the reflective head reflects source light shined onto it from any angle, a trail formed of such markers can be easily detected by shining a source light in the general area of the trail. This can be a disadvantage in many cases, such as where the person marking the trail (such as to a choice fishing or hunting spot) wishes to keep the trail secret, and thus minimize the possibility of others discovering the trail. Reflective trail markers which reflect light in all directions (360° reflection) can also cause confusion in areas which are marked with several trails. A person shining a light into a forest with several trails marked using such (360° reflection) markers may simultaneously see reflections from markers belonging to different trails, making it difficult to discern the desired trail to be followed.

SUMMARY OF THE INVENTION

A reflective trail marker in accordance with the present invention includes a generally "hour-glass" shaped marker head having a central portion and top and bottom cap portions formed at each end of the central portion. The central portion of the marker head has one or more side wall surfaces which are light reflective. The side wall surfaces of the marker head may be formed of a reflective material, or may be made reflective by applying reflective paint or tape thereto. Preferably, the central portion of the marker head is formed to have four flat reflective side wall surfaces at right angles to each other. This shape enhances the reflective surface area of the central portion of the marker head. The top and bottom cap portions of the marker head are non-reflective, and extend beyond the side walls of the central portion of the marker head. The non-reflective cap portions thus prevent illumination of and reflection from the central portion of the marker head at angles varying substantially from perpendicular to the reflective side wall surfaces of the central portion along the axis of the central portion. A pin preferably extends from one end of the marker head, to allow easy attachment of the marker to a support, such as a tree.

Reflective trail markers in accordance with the present invention may be used to mark a trail which is easily visible at night from many directions (360° reflection) or to mark a secret trail wherein the possibility that a person not knowing the general location of the trail will discover the trail is reduced (limited angle reflection). To mark an easily detectable trail, reflective trail markers in accordance with the present invention are mounted such that the top and bottom cap portions are positioned horizontally, for example, by mounting the trail markers on the tops or bottoms of generally horizontal surfaces, such as horizontal tree branches. In such an orientation, a light source shined on to the trail markers from any direction will be reflected back to the source of light from the reflective side wall surfaces of the central portions of the marker heads (the top and bottom cap portions do not restrict radial reflection from the side wall surfaces).

To mark a secret trail, reflective trail markers in accordance with the present invention may be mounted such that the top and bottom cap portions are positioned vertically, such as by mounting the markers on the sides of trees or other structures. By placing the markers in such an orientation, a trail is formed which is less likely to be discovered by someone not knowing the general location of the trail and which is also less likely to be confused with other trails marked with reflective markers. In such an orientation, the non-reflective top and bottom cap portions of the marker heads restrict illumination of and reflection from the reflective side wall surfaces of the central portions of the marker heads to a limited range of angles varying from perpendicular to the reflective side wall surfaces of the marker heads along the axes of the central portions (limited angle reflection). Thus, when mounted for limited angle reflection, a light source must shine onto the reflective trail markers at angles within a limited range of angles for reflected light to be visible by a person at the source of the light. Reflective trail markers in accordance with the present invention may thus be used to mark a private or secret trail which is less likely to be discovered by someone not knowing the general location of the trail. Reflective trail markers in accordance with the present invention may also be mounted for limited angle reflection to mark a trail in areas where others have marked trails using reflective markers. Because a reflective trail marker mounted for limited angle reflection only reflects light shined onto the marker from a limited range of angles, it is less likely that reflective trail markers used for marking one trail will become confused with reflective trail markers used for marking another trail.

Reflective trail markers in accordance with the present invention may be provided as a kit comprising a plurality of such reflective markers, each of which has a non-reflective colored surface (e.g., overhanging top and bottom cap portions) of the same color. Reflective markers of one color can be used to mark one particular trail or a trail belonging to one person, while markers of another color can be used to mark a different trail or another person's trail. In this manner, different trails can be distinguished from one another. Such a kit can be used to mark a trail in accordance with the present invention by selecting one reflective trail marker from the kit, placing the marker in a tree or other support, and repeating the process while proceeding to thereby mark the trail.

Further objects, features and advantages of the invention will be apparent from the following detailed description when taken in conjunction with the accompanying drawings.

BRIEF DESCRIPTION OF THE DRAWINGS

In the drawings:

FIG. 1 is a top view of the reflective trail marker, showing a top cap portion thereof.

FIG. 2 is a bottom view of the reflective trail marker, showing a bottom cap portion thereof and a pin of the marker.

FIG. 3 is a side view of the reflective trail marker, showing a side wall surface, the top and bottom cap portions, and the pin of the marker.

FIG. 4 is a perspective view of the reflective trail marker, showing two side wall surfaces, the top and bottom cap portions, and the pin of the marker.

FIG. 7 is a top view of the reflective trail marker, showing a top cap portion thereof and a portion of a bottom cap portion thereof.

FIG. 8 is a bottom view of the reflective trail marker, showing the bottom cap portion thereof and the pin of the marker.

FIG. 9 is a side view of the reflective trail marker, showing the top and bottom cap portions, a side wall surface, and the pin of the marker.

FIG. 10 is a perspective view of the reflective trail marker, showing the top and bottom cap portions, the side wall surface, and the pin of the marker.

FIG. 11 is a top view of the reflective trail marker, showing a surface of a top wall of the marker.

FIG. 12 is a bottom view of the reflective trail marker, showing a surface of a bottom wall and a pin of the marker.

FIG. 13 is a side view of the reflective trail marker, showing a surface of a side wall and the pin of the marker.

FIG. 14 is a perspective view of the reflective trail marker, showing the surfaces of two side walls, the surface of the bottom wall, and the pin of the marker.

FIG. 15 is a top view of the reflective trail marker, showing an overhanging cap of the marker.

FIG. 16 is a bottom view of the reflective trail marker, showing the overhanging cap, a surface of a bottom wall, and a pin of the marker.

FIG. 17 is a side view of the reflective trail marker, showing the overhanging cap, a surface of a side wall, and the pin of the marker.

FIG. 18 is a perspective view of the reflective trail marker, showing the overhanging cap, the surfaces of two side walls, the surface of the bottom wall, and the pin of the marker.

DETAILED DESCRIPTION OF THE INVENTION

Figure 1:
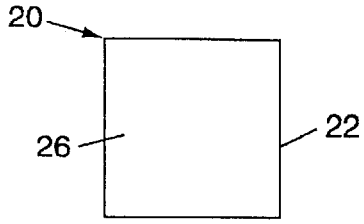
FIGS. 1 to 4 illustrate an exemplary preferred embodiment of a reflective trail marker in accordance with the present invention.
Figure 2:
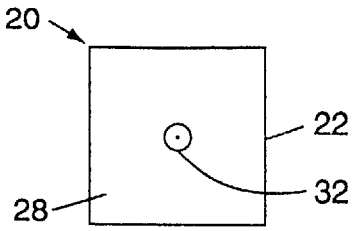
Figure 3:
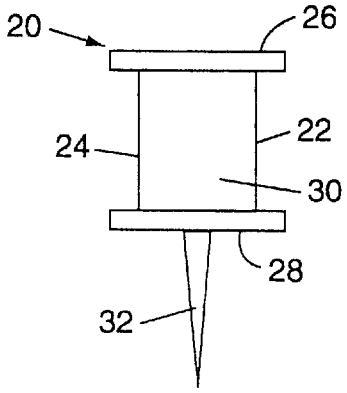
Figure 4:
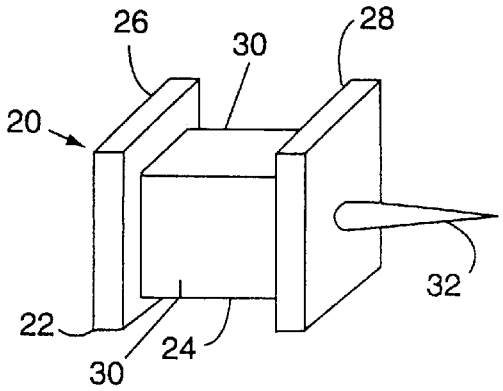
Figure 7:
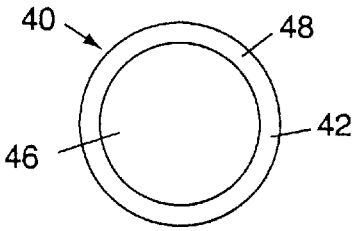
FIGS. 7 to 10 illustrate another exemplary embodiment of a reflective trail marker in accordance with the present invention.
Figure 8:
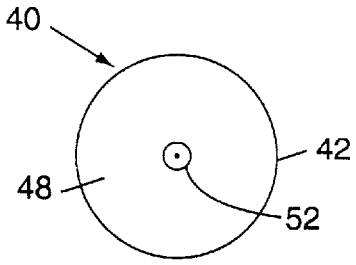
Figure 9:
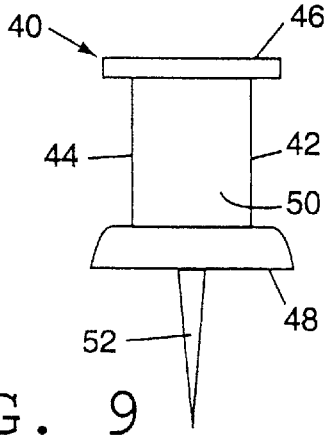
Figure 10:
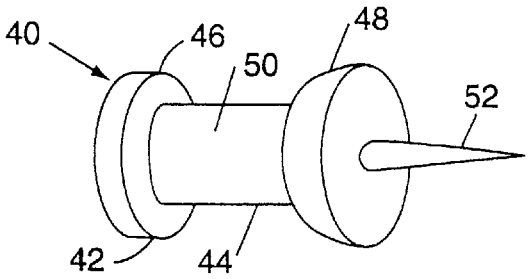

With reference to the drawings, an exemplary reflective trail marker in accordance with the present invention is shown generally at 20 in FIGS. 1–4. The marker 20 has a generally hour glass shaped head 22, having an elongated central portion 24, and top 26 and bottom 28 cap portions formed at each end of the central portion 24. The top 26 and bottom 28 cap portions are preferably parallel to each other. The central portion 24 of the marker head 22 preferably includes multiple flat side walls 30. Preferably, the central portion 24 of the marker head 22 includes four substantially flat side walls formed at right angles to each other. The top 26 and bottom 28 cap portions preferably extend beyond the side walls 30 of the central portion 24 in all directions.

The marker head 22 may be made of any material, but is preferably made of plastic by injection molding or some other process. The surfaces of the side walls 30 of the central portion 24 of the marker head 22 are made light reflective, so that when a light source is shined on the marker head 22, at a correct angle, the marker 20 will become easily visible from a distance at night. The surfaces of the side walls 30 of the central portion 24 of the marker head 22 may be made light reflective by applying a reflective paint, tape, or other coating to the side wall surfaces. A preferred reflective coating is Scotchlite Reflective Liquid, made by 3M Co. Alternatively, the central portion 24 of the marker head 22 may be made of reflective material, such as reflective plastic.

Surfaces of the top 26 and bottom 28 cap portions of the marker head 22 are not light reflective. The top 26 and bottom 28 cap portions may be formed as integral parts of the marker head 22, of a material such as non-reflective plastic, by injection molding or some other process. Alternatively, if the central portion 24 of the marker head 22 is made of a reflective material, such as reflective plastic, the top 26 and bottom 28 cap portions may be made separately, of a non-reflective material, and attached to the central portion 24 in a conventional manner, such as by use of an adhesive, to form the marker head 22.

The marker head 22 may be any size, but a marker head 22 having a central portion 24 between approximately ⅛" and ¼" across is preferred. For a given size of the central portion 24 of the marker head 22, the number of side walls 30 forming the central portion 24 determines the area of each individual side wall 30 and its angle. As the number of side walls 30 increases, the area of each individual side wall 30 decreases. While increasing the number of side walls 30 increases the range of angles at which light can be reflected back from the head 22, decreased individual surface area results in less light being reflected from each side wall 30. As discussed previously, in accordance with the present invention, the preferred number of side walls 30 for the central portion 24 of the marker head 22 is four. However, the central portion 24 of the marker head 22 may also have more or fewer side walls 30.

The head 22 of a trail marker 20 in accordance with the present invention may be fastened to a support structure, such as a tree, to thereby mark a trail, by a variety of methods and structures. Preferably, a metal pin 32 is attached to the head 22 for this purpose. The metal pin 32 preferably protrudes from the bottom cap portion 28 of the head 22, along a central axis of the head 22. The metal pin 32 may be attached to the head 22 in a conventional manner, such as during the process of making the head 22. The metal pin allows a marker 20 in accordance with the present invention to be easily attached to and removed from a support structure with one hand. Another method of attaching a reflective trail marker 20 in accordance with the present invention to a support structure is by applying a sticky adhesive to a bottom surface of the bottom cap portion 28 of the marker head 22.

Figure 5:
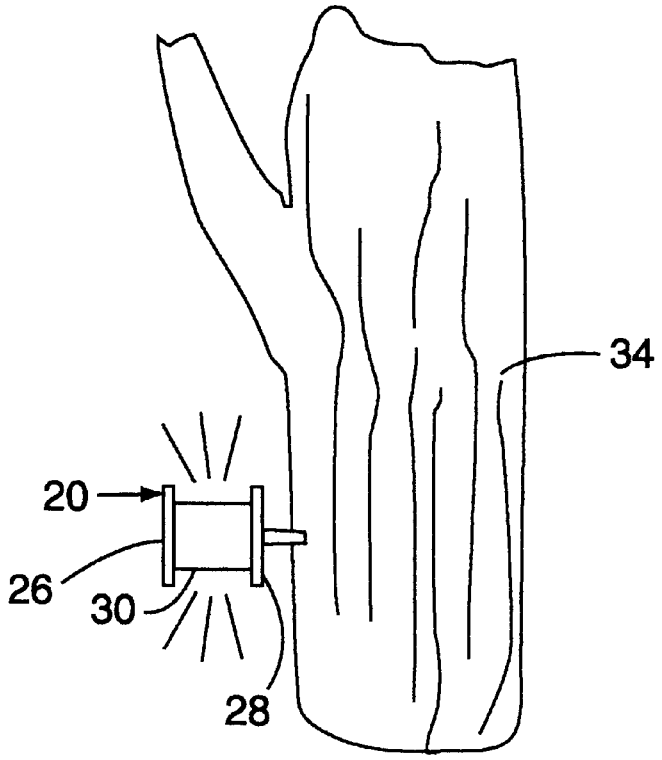
FIG. 5 is an illustration of a reflective trail marker in accordance with the present invention mounted on a vertical support structure to provide limited angle reflection.

A reflective trail marker 20 in accordance with the present invention may be fastened to a support structure, such as a tree, to provide either 360° reflection or limited angle reflection. FIG. 5 illustrates a reflective marker 20 in accordance with the present invention mounted to a vertical support structure 34, such that the top 26 and bottom 28 cap portions are positioned in a vertical direction. In this orientation, the marker 20 provides limited angle reflection. Imagine a sportsman shining a light on the marker 20 from a direction in front of FIG. 5. The reflective side wall surfaces 30 of the marker 20 will reflect the light back to the sportsman, and the marker 20 will be easily visible. Similarly, the marker 30 will be easily visible if illuminated by a light source from a direction behind FIG. 5 (out of the page). However, a sportsman shining a light on the marker 20 from either the left or right side of FIG. 5 will not see a reflection from the marker head 22. In this case, the non-reflective top 26 and bottom 28 cap portions prevent the reflective side walls 30 of the central portion 24 of the marker head 22 from being illuminated. The top and bottom cap portions 26 and 28 may extend beyond the side walls 30 of the central portion 24 by any amount, however, the more the cap portions 26 and 28 extend over the reflective side walls 30, the narrower will be the reflective angle, in front of or behind the marker 20, from which the reflective side wall surfaces of the marker 20 will be visible. In other words, the top 26 and bottom 28 cap portions limit the reflective angle of the marker 20 to a limited range of angles on either side of perpendicular to the reflective side wall surfaces of the central portion 24 of the marker head 22 along the axis of the central portion 24 of the marker 20.

Reflective trail markers 20 in accordance with the present invention, mounted on vertical support structures for limited angle reflection, as illustrated in FIG. 5, may be used to mark a private or secret trail. Since the reflective side wall surfaces 30 of the markers 20 are only visible at a limited range of angles, a person must know the general location of the trail for the trail to be discovered and followed. For someone who does know the general location of the trail, however, a trail marked with reflective trail markers 20 in accordance with the present invention fastened to support structures for limited angle reflection will be easily visible at night in both trail directions, (e.g., in and out of a forest). Also, since reflective trail markers 20 in accordance with the present invention fastened to support structures to provide limited angle reflection only reflect at limited angles, the chance that a trail marked with such markers will become confused with other trails marked in a similar way is greatly reduced.

Figure 6:
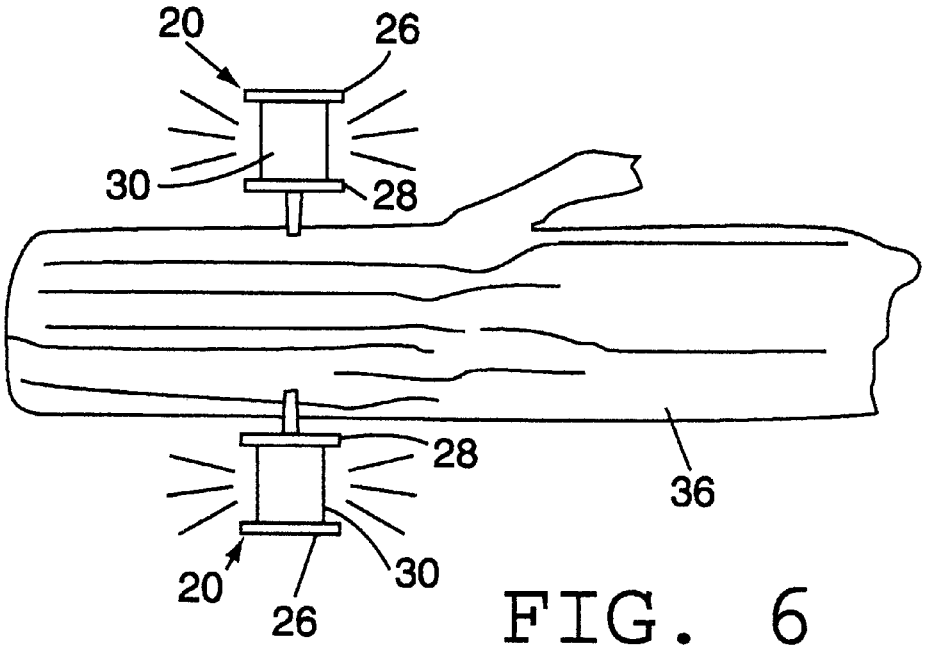
FIG. 6 is an illustration of two reflective trail markers in accordance with the present invention mounted on a horizontal support structure to provide 360° reflection.
Figure 11:
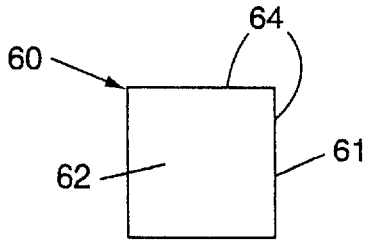
FIGS. 11 to 14 illustrate yet another exemplary embodiment of a reflective trail marker in accordance with the present invention.
Figure 12:
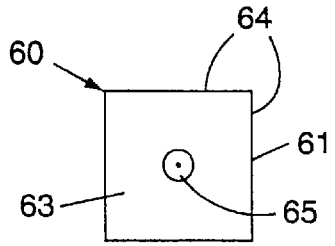
Figure 13:
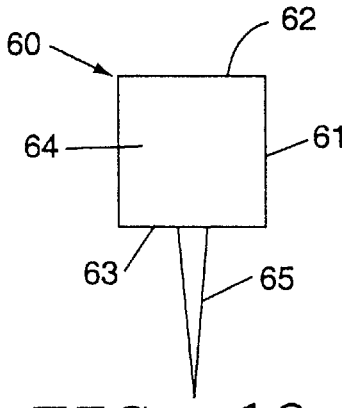
Figure 14:
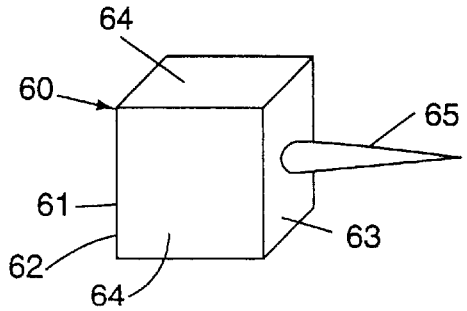
Figure 15:
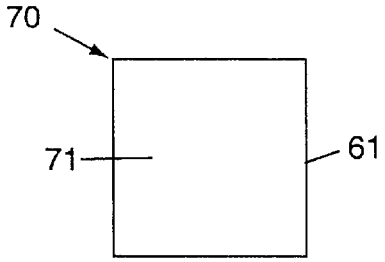
FIGS. 15 to 18 illustrate still another exemplary embodiment of a reflective trail marker in accordance with the present invention.
Figure 16:
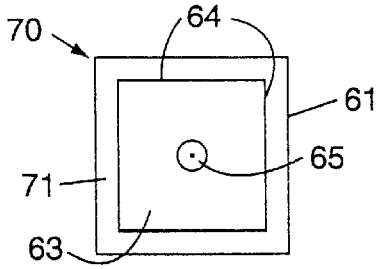
Figure 17:
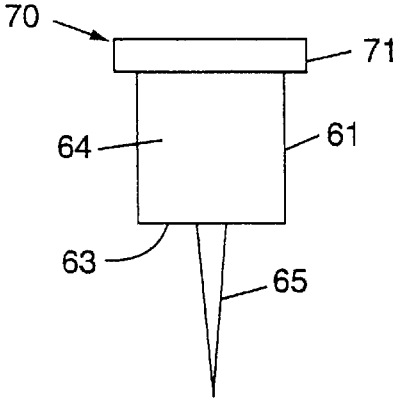
Figure 18:
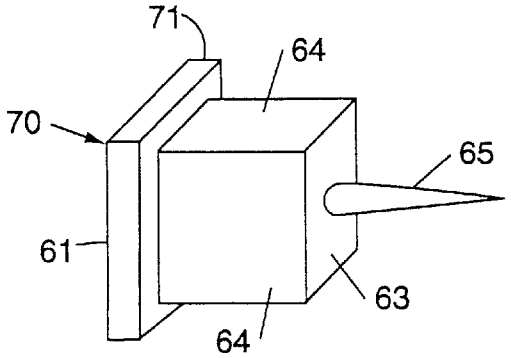

FIG. 6 illustrates two reflective trail markers 20 in accordance with the present invention fastened to a horizontal support structure 36 such that the top 26 and bottom 28 cap portions are positioned in a horizontal direction. As is apparent from FIG. 6, a reflective trail marker 20 mounted in this horizontal orientation has reflective side wall surfaces facing in all directions. Thus, mounting a reflective trail marker 20 in accordance with the present invention on a horizontal support structure provides a 360° angle of reflection from the marker 20. By marking a trail using markers 20 oriented in this manner, a trail which is easily detectable at night from all directions may be created. A reflective trail marker 20 in accordance with the present invention may be fastened to a horizontal support structure to reflect in all directions for purposes other than trail marking. For example, a reflective trail marker 20 in accordance with the present invention may be fastened to the top of a floating object, in a horizontal orientation, thereby making the location of the floating object easily detectable at night when a light source is shined on to the object from any direction.

It should be noted that reflective trail markers in accordance with the present invention need not have flat reflective side wall surfaces. For example, an alternative exemplary reflective trail marker in accordance with the present invention is shown generally at 40 in FIGS. 7–10. This marker 40 also has a generally hour glass shaped head 42, having a central portion 44, and flat top 46 and bottom 48 cap portions. However, in this case, the side wall 50 of the central portion 44 of the marker head 40 is cylindrical in shape. As discussed previously, the surface of the side wall 50 is light reflective, and the top 46 and bottom 48 cap portions are non-reflective and extend over the reflective side wall surface of the central portion 44 of the marker head 40, thereby limiting the angle of reflection from the reflective side wall surface when the marker 40 is attached to a vertical support structure for limited angle reflection. When fastened to a horizontal support structure, the cylindrical reflective side wall surface provides 360° reflection. A metal pin 52 protruding from the bottom cap portion 48 provides a means for fastening the marker 42 to a support structure.

Another exemplary reflective trail marker in accordance with the invention is shown generally at 60 in FIGS. 11–14. The marker 60 has a polygonal head 61, which has a flat top wall 62, a flat bottom wall 63, and multiple side walls 64. The top 62 and bottom 63 walls are preferably perpendicular to the side walls 64. As discussed previously, the marker head 61 may be made of any material, but is preferably made of plastic by injection molding or some other process. The surfaces of the side walls 64 are made light reflective so that when a light source is shined on the marker head 61, the marker 60 will become easily visible from a distance. The surfaces of the top 62 and bottom 63 walls are not light reflective. Therefore,when the marker 60 is attached to a vertical support structure, the angle of reflection from the reflective marker head 61 is limited. Preferably, a metal pin 65 protrudes from the bottom wall 63 of the reflective head 61 to provide a means for attaching the marker 60 to a support structure.

Yet another exemplary embodiment of a reflective trail marker in accordance with the present invention is shown generally at 70 in FIGS. 15–18. This embodiment of the present invention is substantially the same as that described above, with reference to FIGS. 11–14, except an overhanging cap 71 is attached to the top wall 62 of the reflective head 61. The overhanging cap 71 is preferable made of the same material, e.g., plastic, as the reflective head 61, and may be integrally formed as part of the head 61 during the process of forming the head, or may be attached to the top surface of the head 61 using, e.g., an adhesive. The overhanging cap 71 is not coated with a reflective material. The overhanging cap 71 thus limits the angle of reflection from the reflective side walls 64 when the marker is attached to a vertical support structure for limited angle reflection, in the manner described previously.

In accordance with the present invention, the non-reflective surfaces of a marker (20, 40, 60, or 70) in accordance with the present invention are preferably brightly colored, e.g., yellow, blue, red, green, or white. Coloring of the non-reflecting surfaces may be achieved by forming the reflective trail marker from a brightly colored plastic material. Alternatively, color may be applied to the non-reflecting surfaces by applying a colored coating, e.g., paint or tape, to the non-reflecting surfaces. Brightly colored non-reflective surfaces make a reflective trail marker in accordance with the present invention more easily visible in the daylight.

Reflective trail markers in accordance with the present invention may be provided as a kit. In accordance with the present invention, a kit of reflective trial markers includes a plurality of trail markers wherein each trail marker in the kit includes a colored non-reflecting surface of the same color. Such a kit may be used to mark a trail which is distinguishable from trails made with trail markers from other such kits having trail markers with non-reflecting surfaces which are of a different color. Thus, a hunter or other outdoor sportsperson may use different reflective trail marker kits in accordance with the present invention to mark different trails, or different hunters and sportsmen may use different reflective trail marker kits in accordance with the present invention to distinguish one hunter or sportsman's trail from that of other hunters and sportsmen.

The use of reflective trail markers 20 in accordance with the present invention to mark a trail is illustrated in, and will be described with reference to, FIG. 19. A reflective trail marker 20 is attached securely to a tree 80, or other support structure, by inserting the marker pin 32 into the tree 80 or other support structure. To enhance the visibility of the trail marker 20 during daylight, a piece of ribbon (not shown) may be attached to the tree 80 or other support structure, via the reflective trail marker pin 32, along with the trail marker 20. Preferably, the ribbon may be colored the same color as the non-reflective surfaces of the trail marker 20. Reflective trail marker kits in accordance with the present invention may include pieces of ribbon having the same color as the non-reflecting surfaces of the reflective trail markers included in the kit.

Figure 19:
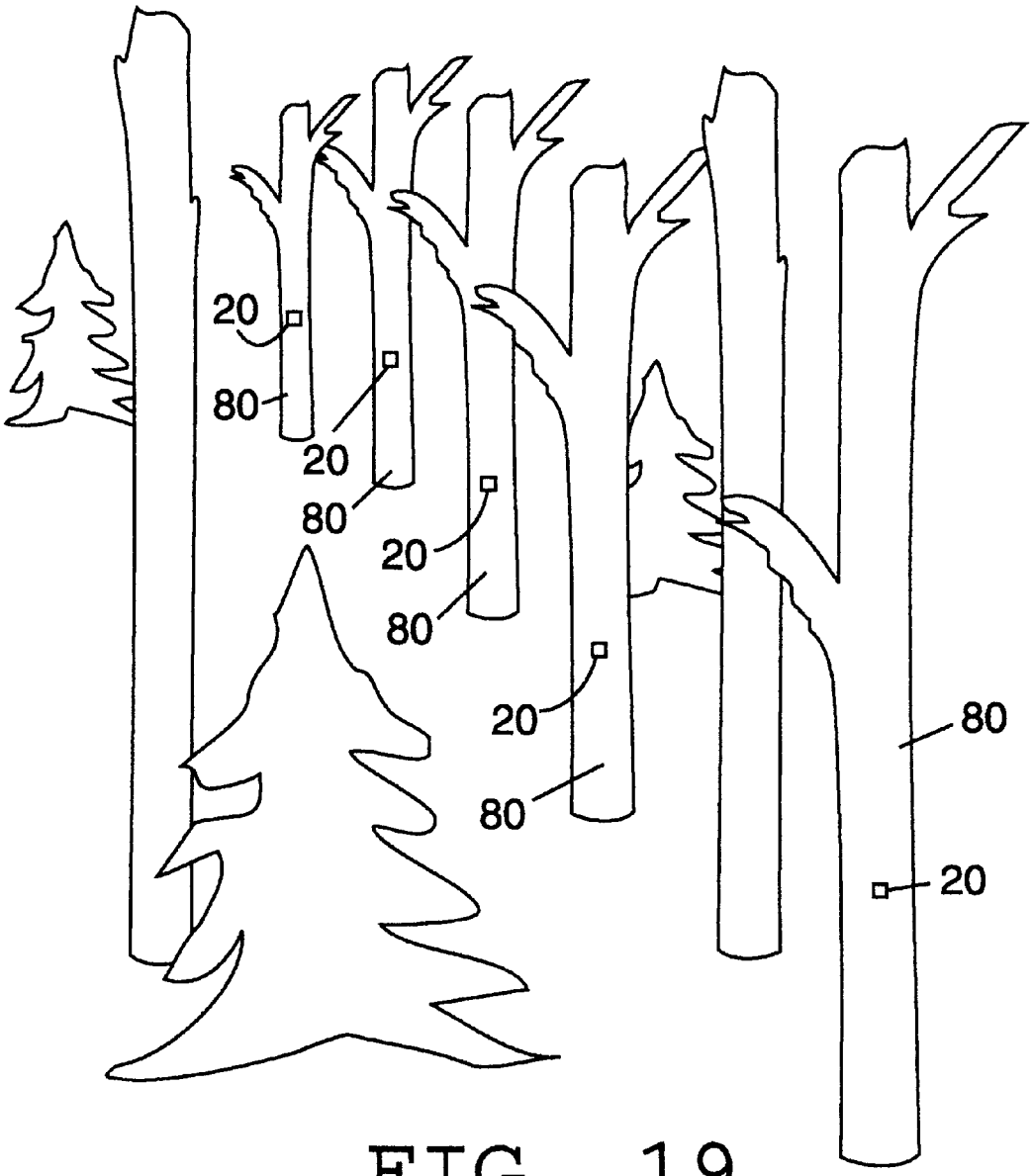
FIG. 19 is an illustration of a forest trail as marked with reflective trail markers in accordance with the present invention.

As illustrated in FIG. 19, a series of trail markers 20 are attached to a series of trees 80 or other supports, preferably within line of sight of each other, to create a trail which is visible during day or night. In the dark, a trail formed using trail markers in accordance with the present invention is made visible by shining a light, such as from a flashlight, in the general direction of the trail. The light will catch the reflective coating material on side walls 30 of the trail marker 20, and will be reflected back. At least some of the reflected light will reflect back in the direction of the light source, making the reflective trail marker 20 of the present invention highly visible to the person shining the light on the trail. Of course, the angles at which light is reflected from a trail marker 20 will depend on the incident angle of the source light and, as described previously, whether the marker 20 is mounted horizontally (360° reflection) or vertically (limited angle reflection).

It is understood that this invention is not limited to the particular embodiments herein illustrated and described, but embraces such modified forms thereof as come within the scope of the following claims.

What is claimed is:

1. A reflective marker, comprising:

(a) a marker head having a central portion having a plurality of flat reflective side wall surfaces and non-reflective flat top and bottom cap portions parallel to each other and perpendicular to an axis of the central portion and overhanging the reflective side wall surfaces of the central portion; and (b) a fastening means attached to the marker head for attaching the marker head to a support structure.

2. The reflective marker of claim 1 wherein the central portion has four flat reflective side wall surfaces.

3. The reflective marker of claim 1 wherein the fastening means is a metal pin protruding from the bottom cap portion of the marker head.

4. The reflective marker of claim 1 wherein a surface of the top cap portion is colored with a color selected from the group of colors consisting of red, green, blue, yellow, orange, and white.

5. A reflective marker kit, comprising a plurality of reflective markers wherein each reflective marker comprises:

a marker head having a central portion having a plurality of flat reflective side wall surfaces and non-reflective flat top and bottom cap portions parallel to each other and perpendicular to an axis of the central portion and overhanging the reflective side wall surfaces of the central portion; and a fastening means attached to the marker head for attaching the marker head to a support structure, wherein a surface of the top cap portion of each reflective marker in the kit is colored the same color.

6. The reflective marker kit of claim 5 wherein the central portion of each marker in the kit has four perpendicular flat reflective side wall surfaces.

7. The reflective marker kit of claim 5 wherein the fastening means of each marker in the kit is a metal pin protruding from the bottom cap portion of the marker head.

8. The reflective marker kit of claim 5 wherein the surface of the top cap portion of each marker in the kit is colored with a color selected from the group of colors consisting of red, green, blue, yellow, orange, and white.

* * * * *